US006385940B1

(12) United States Patent
Maier et al.

(10) Patent No.: US 6,385,940 B1
(45) Date of Patent: May 14, 2002

(54) METHOD AND APPARATUS FOR STRENGTHENING/RESTORING A REINFORCED/PRESTRESSED CONCRETE STRUCTURE

(75) Inventors: Markus Maier, Stuttgart; Dieter Sandner, Weinstadt; Hans-Peter Andra, Stuttgart, all of (DE)

(73) Assignee: Leonhardt, Andra und Partner Beratende Ingenieure GmbH, Stuttgart (DE)

( * ) Notice: Subject to any disclaimer, the term of this patent is extended or adjusted under 35 U.S.C. 154(b) by 0 days.

(21) Appl. No.: 09/509,259

(22) PCT Filed: Sep. 24, 1998

(86) PCT No.: PCT/EP98/06099

§ 371 Date: Jun. 16, 2000

§ 102(e) Date: Jun. 16, 2000

(87) PCT Pub. No.: WO99/15744

PCT Pub. Date: Apr. 1, 1999

(30) Foreign Application Priority Data

Sep. 24, 1997 (DE) ..... 197 42 210

(51) Int. Cl.[7] ..... E04G 23/02

(52) U.S. Cl. ..... 52/730.2; 52/745.21; 52/724.1; 52/724.5; 52/601; 52/223.8; 52/223.13; 52/223.14

(58) Field of Search ..... 52/730.2, 745.21, 52/724.1, 724.2, 223.1, 223.13, 223.14, 600, 601, 724.5, 223.8

(56) References Cited

U.S. PATENT DOCUMENTS

| | | | | | |
|---|---|---|---|---|---|
| 3,290,840 | A | * | 12/1966 | Middendorf | 52/223.13 |
| 3,368,016 | A | * | 2/1968 | Birguer | 52/724.5 X |
| 3,468,090 | A | * | 9/1969 | L'Hermite | 52/730.2 X |
| 5,479,748 | A | * | 1/1996 | Siller | 52/223.8 X |
| 5,617,685 | A | * | 4/1997 | Meier et al. | 52/223.13 X |
| 5,768,847 | A | * | 6/1998 | Policelli | 52/730.2 X |
| 5,937,606 | A | | 8/1999 | Meier et al. | |

FOREIGN PATENT DOCUMENTS

| | | | | |
|---|---|---|---|---|
| JP | 2-266050 | * | 10/1990 | 52/223.13 |
| WO | WO97/21009 | | 6/1997 | |
| WO | WO 99/10613 | * | 3/1999 | |

* cited by examiner

*Primary Examiner*—Laura A. Callo
(74) *Attorney, Agent, or Firm*—Burns, Doane, Swecker & Mathis, L.L.P.

(57) ABSTRACT

A reinforced or prestressed concrete structure is strengthened and/or restored by attaching a strip-shaped tensional member thereto. Prior to attaching the tensional member, a central portion thereof is prestressed. Then, the tensioned central portion is bonded to a concrete surface of the concrete structure by a first adhesive having a high deformation modulus. Thereafter, the non-prestressed end portions of the tensional member are bonded to the concrete surface by a second adhesive having a low deformation modulus, whereby the second adhesive is substantially less deformable than the first adhesive.

12 Claims, 3 Drawing Sheets

METHOD AND APPARATUS FOR STRENGTHENING/RESTORING A REINFORCED/PRESTRESSED CONCRETE STRUCTURE

BACKGROUND OF THE INVENTION

The invention related to a method and strip-shaped tensional member for strengthening and/or restoring reinforced or prestressed concrete supporting structures.

It is well known to attach prestressed tensional members to the outside of supporting structures to increase the load carrying capacity (strengthening) or to restore to the original load carrying capacity (restoration) supporting structures made of reinforced or prestressed concrete.

For example, brackets made of steel or reinforced concrete are anchored with dowels to the concrete surface. However, due to a relative shifting (displacement) between the axis of the tensional member and the concrete surface there is an unfavorable shift movement created, which has to be absorbed and transferred by the bracket anchoring; in addition, a bond between the tensional member and the concrete surface cannot be produced.

To avoid disadvantages caused by the shift between the tensional member and the concrete surface, it has been disclosed in a method of the type mentioned in the beginning to later attach, with an adhesive, strip-shaped tension members for strengthening and/or restoring reinforced or prestressed concrete support structures. Such a continuous adhesive joint is especially of significance if cracks are present or could occur in the concrete or further widening of the cracks is to be prevented.

If tensional members are bonded to a concrete surface in a stressed condition, then the adhesive joint becomes stressed over a period of time by the introduction of the shearing (transverse) force as a result of the prestress force. Adhesive agents with the lowest possible deformation modulus are used, which offer a rigid adhesive joint to the greatest extent in its hardened condition to avoid creep losses as a result of this shearing stress on the adhesive joint.

High-strength (high tensile strength), thin, and thereby comparably light strips are preferably employed as tensional members for easy handling. The strips made of high-strength material are usually linear elastic up to the point of fracture; an upper flow level is not present in such high-strength materials, which means an area of near constant force over the path of expansion.

If thusly constructed band-shaped prestressed tensional members cover cracks in the concrete surface, which open up during added stress on the support structure, then there is the danger with the described rigid adhesive Joint that the tensional member is stretched passed the crack edges in the crack area to such an extent that there occurs a sudden fracture in this type of strip without prior indication of elastic deformation.

This lack in ductility is a disadvantage and considerably limits the possible utilization factor of the tension members. Therefore adhesive joint agents must be selected for use in the areas in which cracks are to be covered, which have a specific deformation characteristic themselves, which means a high deformation modulus, so that during opening of the cracks an expansion compensation can take place in the tensional member over a length that is clearly greater than the degree of added widening of the cracks. However, such types of adhesive joint agents with high de formation modulus are not suited for permanent anchoring because of the associated creep losses.

In addition, there is the problem that at both ends of the prestressed tensional members the tie force has to be introduced into the minor structure (substructure). In traditional prestressed concrete structures there is provided a so-called rear suspended reinforcement therefor, which prevents development of cracks immediately behind the anchoring of the tensional member. Such a rear suspended reinforcement is also necessary in later attached prestressed tensional members.

In a known method of the type mentioned in the beginning (WO 97/21009, FIG. 5) there is a tensional member provided with fiber components, which is glued—while prestressed at its middle area of its length—to the concrete surface of a supporting structure. The tensional member is clamped at its two end areas into a clamping device, which is joined to the supporting structure via a ductile deformable transition element. The ductile deformable transition element is a bonding agent, which deformation modulus is substantially higher than that of the adhesive joint agent in the middle area of the tensional member. Since the anchoring of the tensional means at its end areas is effective only during excessive load conditions on the tensional means over the entire middle area, which means only in case of local excessive loads, the danger of fracture in the area of cracks is thereby not a voided.

The object of the invention is to overcome the cited disadvantages and to provide a method for strengthening and/or restoring reinforced or prestressed concrete supporting structures, whereby the danger of a fracture in the areas of cracks is avoided through the avoidance of a shift moment during the direct attachment of the strip-shaped tensional member on the concrete surface, and whereby creep losses are excluded.

SUMMARY OF THE INVENTION

This object is achieved according to the invention in that the second deformation modulus is substantially lower compared to the first deformation modulus.

In the prestressed area, which extends over the most part of the length of the tensional member, there axe from the start no shearing forces transmitted via the adhesive joint agent between the tensional member and the concrete surface. Only when expansions and particularly cracks develop in the concrete, then there occurs a transfer of shearing forces in local, small areas between the tensional member and the concrete surface. However, since there is an adhesive joint agent used with comparably soft shearing properties in the middle area of the tensional member, there occurs an expansion compensation in the tensional member over the width of the crack so that, in general, a ductile process is employed.

The extensions at the two end areas of the tensional member, which axe not prestressed, serve as anchoring and rear suspended reinforcement. Since an adhesive joint agent with low deformation modulus—which means a generally rigid adhesive joint agent—is used in the area that is not prestressed, the prestress force is transmitted into the concrete without creep losses to a great extent.

The surface-bonding arrangement of the strip-shaped member prevents the development of a shift moment. A separate anchoring and rear suspended reinforcement is not necessary since these functions are achieved in an especially simple and space-saving fashion by the rigid adhesive connection of the non-stressed end areas of the tensional member with the concrete surface.

The invention relates further to a strip-shaped tensional member for strengthening and/or restoring concrete supporting structures. Starting with a strip-shaped tensional member for strengthening and/or restoring concrete supporting structures that is prestressed in a middle area of its length and which is joined to said concrete surface by means of a first bonding agent with a first deformation modulus, and which joined at its two end areas, which are not in a prestressed condition, by means of a second bonding agent with a second deformation modulus, the novel tensional member is characterized in that the second deformation modulus is substantially lower in comparison to the first deformation modulus. The tensional member may consist of steel fibers, synthetic fibers, or preferably carbon fibers.

Finally, the invention also relates also to a device to carry out the method (process) of a strip-shaped tensional member being arranged on a concrete surface with tensioning devices and end anchoring. This device, according to the invention, is characterized in that the tensioning device is provided with a force introduction body that is joined by positive fit to strip-shaped tensional means, which may be moved by sliding in a longitudinal direction of the tensional means relative to a base body attached to the supporting structure, wherein a tensioning drive may be inserted between the force introduction body and the base body, and wherein at least one spacer may be inserted between the buttress surfaces of the base body, which face one another, and the force introduction body.

This tensioning device, which is preferably disposed at one or preferably at both ends of the middle prestressed area of the tensional member, is able to supply the necessary prestress force on the middle area of the tensional member in a structural and space-saving fashion whereby the two ends of the tensional member, which are outside the force introduction points, are not prestressed.

BRIEF DESCRIPTION OF THE DRAWINGS

In the following, an embodiment example of the invention is described in more detail with reference to drawings.

DETAILED DESCRIPTION OF PREFERRED EMBODIMENTS OF THE INVENTION

Figure 1:
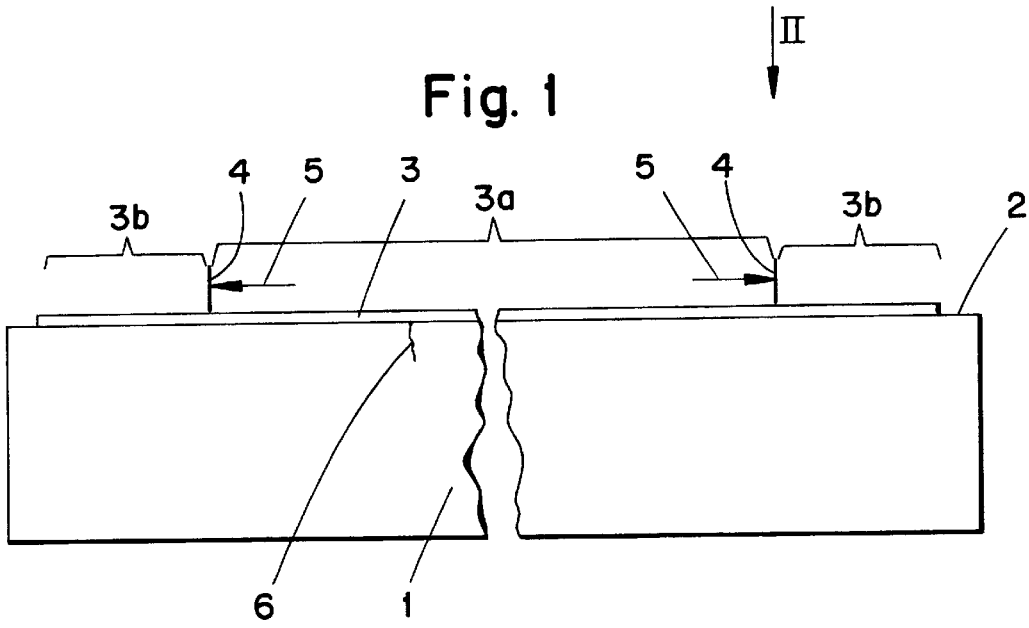
FIG. 1 shows in a simplified illustration a reinforced or prestressed concrete supporting structure with a tensional member attached thereon.
Figure 2:
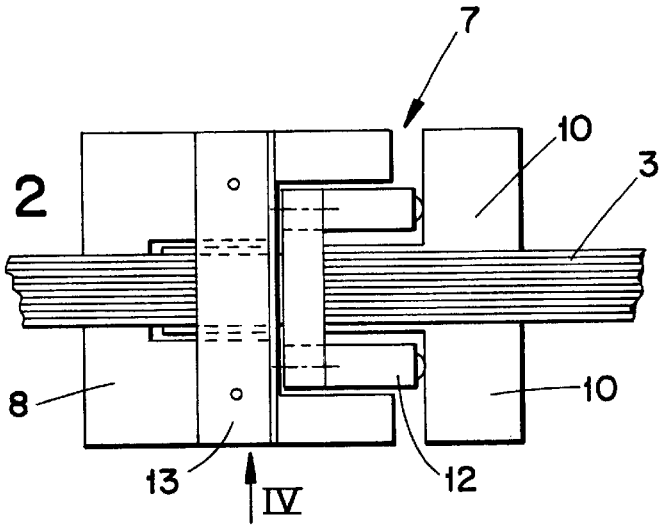
FIG. 2 shows a tensioning device in its initial condition disposed at one force introduction point taken at a view in the direction of the arrow II in FIG. 1.
Figure 3:
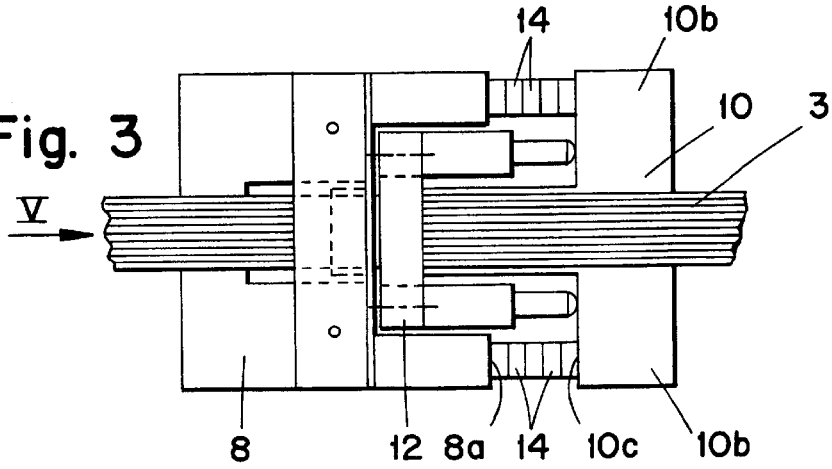
FIG. 3 shows the tensioning device according to FIG. 2 after the tensioning process.
Figure 4:
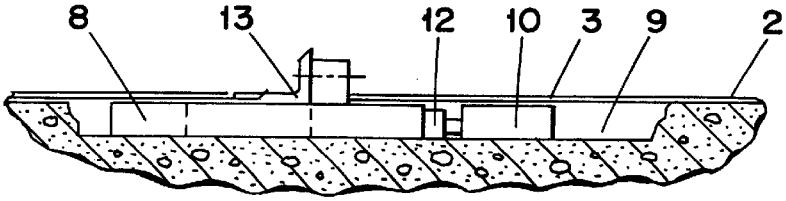
FIG. 4 depicts a view of the tensioning device taken in the direction of the arrow IV in FIG. 2.
Figure 5:
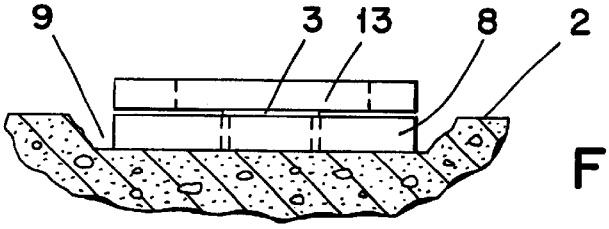
FIG. 5 depicts a view of the tensioning device taken in the direction of the arrow V in FIG. 3.
Figure 6:
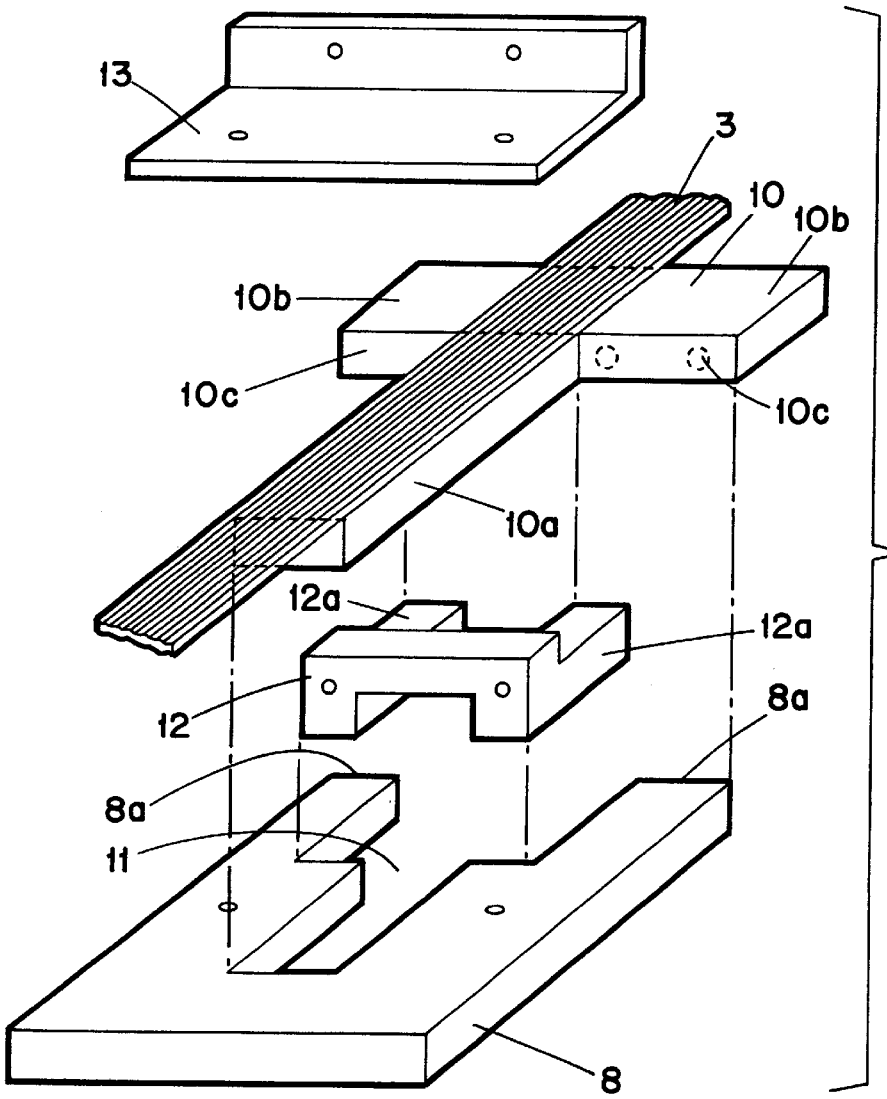
FIG. 6 illustrates the tensioning device in an exploded view according to FIG. 2 through FIG. 5.

For strengthening or restoring a reinforced or prestressed concrete supporting structure 1 there is a strip-shaped tensional member 3 attached to its concrete surface 2 whereby said tensional member consists of carbon fibers, for example. The middle area 3*a* of the tensional member 3 is prestressed between two force introduction points 4 by a prestress force indicated by arrows 5 in FIG. 1. The tensional member 3 is not prestressed at its two end areas 3*b* that are disposed outside said force introduction points 4.

In its middle prestressed area 3*a*, the strip-shaped tensional member 3 is joined to the concrete surface 2 by means of a first adhesive joint agent, which has a relatively high deformation modulus. At its two end areas 3*b*, said tensional member 3 is joined to the concrete surface 7 by means of a second adhesive joint agent, which has, in contrast, a substantially lower deformation modulus; this second adhesive joint agent is substantially rigid in its hardened condition.

If during stress conditions on the supporting structure 1 an existing or developing crack 6 opens up in the concrete surface 3, then an expansion compensation occurs in the tensional member 3 on both sides of the crack 6 as a result of the deformation characteristics of the adhesive joint agent.

A tensioning device 7 is arranged at both force introduction points 4 to apply a prestress force to the middle area 3*a* of the tensional member 3, as illustrated in FIG. 2 through FIG. 6.

Each tensioning device 7 is provided with a base body 8 in the shape of a plate, which is attached to the bottom of a flat recess 9 in the concrete surface 2, preferably by adhesion.

A force introduction body 10, which is T-shaped in its horizontal projection, is attached to the under-side of the strip-shaped tensional member 3 along the T-extension 10*a* whereby it is preferably adhered thereto and whereby it is disposed in a recess 11 of the base body 8 in such a manner that the force introduction body 10 is also countersunk in the recess 9 of the concrete surface 2. The joint surface that is joined preferably by adhesion to the tensional member 3 (which means the top surface of the T-extension 10*a* of the force introduction body 10) lies in the plane of the concrete surface 2.

The connection between the T-shaped force introduction body 10 and the strip-shaped tensional member 3 may be alternatively designed as follows:

1. The T-extension 10*a* may be designed to be longer that illustrated.
2. A second T-shaped force introduction body (not shown) may be arranged on the opposite side of the first force introduction body 10 and may be joined to the tensional member 3 and the force introduction body 10.
3. Fins, for example steel fins, may be adhered to the tensional member 3 and attached to the force introduction body 10—also by adhesion or by positive fit—to improve force introduction into the strip-shaped tensional member.

At the two T-cross sections 10*b* of the force introduction body 10 there engages a hydraulic or mechanical tensioning element of a tensioning drive 12, which is braced against the base body 8. In the illustrated embodiment example, the tensioning drive 12 is provided with two hydraulic tensioning cylinders 12*a* disposed on both sides of the T-extension 10*a*, which engage at both T-cross sections 10*b*. An angled covering 13 is connected to the base body 8 and serves as an attachment for the tensioning drive 12.

The tensional member 3 is prestressed between the tensioning drives 7 of the two force introduction points 4 after application of its middle area 3*a* to the concrete surface 2 and before hardening of the first adhesive joint agent. At least one spacer 14 is inserted between buttress surfaces 10*c* of the force introduction body 10 and the buttress surface 8*a* of the base body 8 that face one another to mechanically attach the tensional member with a positive fit (relative to the concrete surface) to at least one, but preferably to the two force introduction points 4 after employing the prestress force. In the illustrated embodiment example, the spacer 14 consists of several pieces of sheet metal with which the force introduction body 10 wedged in place opposite to the base body 8.

The tensioning drive 12 may be removed from the tensioning device 7 after the wedging process so it can be employed to prestress another tensional member.

The force introduction body 10 is preferably also provided with an adhesive joint agent on its under-side, which substantially hardens into a rigid adhesive joint after the tensioning process.

The end areas 3*b* of the tensional member 3 are attached to the concrete surface 2 by means of an adhesive joint agent, which is substantially rigid after hardening. The end areas 3*b* that are attached in this fashion to the concrete surface 2 form a rear suspended reinforcement for the two ends of the tensional member 3.

Figure 7:
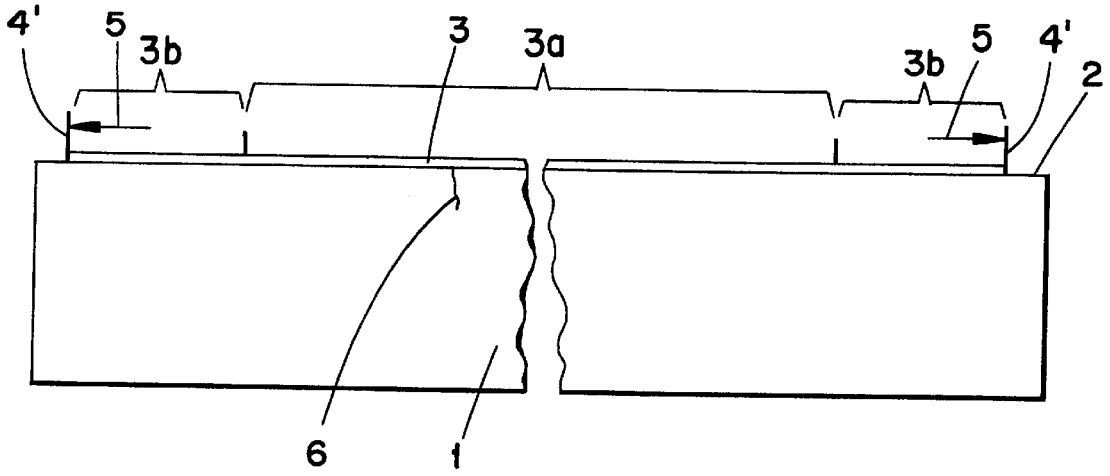
FIG. 7 shows in an illustration according to FIG. 1 a reinforced or prestressed concrete supporting structure comprising a tensional member that is attached in a modified process.

In the presently described embodiment example, according to FIG. 1, the prestress force for the middle area 3*a* has been introduced at two force introduction points 4 that are disposed between the middle area 3*a* and the adjoining end area 3*b*, respectively. As a modification thereof there is illustrated in FIG. 7 that the prestress force 5 may be introduced via the force introduction points 4' that are disposed at the ends of the tensional member 3 after the first adhesive joint agent has been applied to the middle area 3*a*. After this first adhesive joint agent has hardened, then the ends of the tensional member 3 are separated (by cutting, for example) from the tensioning devices that are disposed at the force introduction points 4'. The end areas 3*b* of the tensional member 3 are folded upright and coated with a second adhesive joint agent and then they are attached to the concrete surface with said adhesive joint agent.

Figure 8:
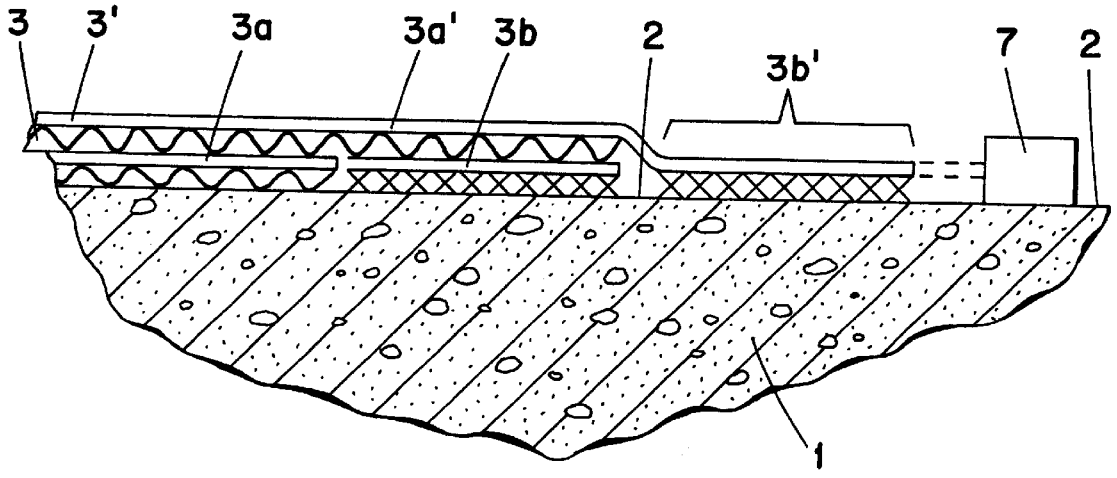
FIG. 8 shows in a schematic longitudinal view the ends of a plurality of tensional members lying on top of one another.

In FIG. 8 it is shown that several strip-shaped tensional members 3, 3' may be applied on top of each other, one after the other. At first, the lowest strip-shaped tensional member 3 is attached to the concrete surface 2 in the already described manner. After hardening of the adhesive joint agent under the middle area 3*a* and the end area 3*b*, a second strip-shaped tensional member 3' is laid on top of the first strip-shaped tensional member again with an adhesive joint agent that has a high deformation modulus (illustrated by a wavy line.) The tensioning device 7 that is attached to both ends provides the necessary prestress force.

After the adhesive joint agent has hardened under the middle area 3*a'*, then the end of the tensional member 3' is separated from the tensioning device 7 in the manner described above. The end areas 3*b'* are folded upright, coated with an adhesive joint agent with low deformation modulus, and then glued to the concrete surface 2.

This process may be repeated several times by applying one after the other a plurality of tensional members on top of each other whereby the respective end areas 3*b*, 3*b'* . . . are attached rigidly, directly onto the concrete surface 2.

The tensioning device 7 may be completely removed from the concrete surface 2 after all tensional members 3, 3' have been applied; only the base plate 6 may remain, whereas all other components of the tensioning device 7 are removed.

What is claimed is:

1. A method for strengthening/restoring a reinforced/prestressed concrete structure, comprising the steps of:

A) prestressing a middle portion of a length of a strip-shaped tensional member;

B) joining the prestressed middle portion to a concrete surface of the concrete structure by a first bonding agent having a first deformation modulus; and C) joining two non-prestressed end portions of the tensional member to the concrete surface by a second bonding agent having a second deformation modulus substantially lower than the first deformation modulus.

2. The method according to claim 1 wherein steps B and C comprise using an adhesive as the first and second bonding agents.

3. The method according to claim 2 wherein step A comprises engaging the middle portion against the concrete surface, with the first bonding agent disposed therebetween, and then pre-stressing the middle portion by applying tension to two points on the tensional member before the first bonding agent hardens.

4. The method according to claim 1 wherein step A is performed by applying tension to two points on the tensional member, the two points disposed between the middle portion and respective ones of the end portions.

5. The method according to claim 4 further including the step of mechanically holding the tensional strip in a prestressed state following step A and during step B.

6. The method according to claim 4 further including, prior to step A, the step of adhering the tensional member to a force introduction body which slides relative to the concrete surface during step A.

7. The method according to claim 1 wherein step A comprises engaging the middle portion against the concrete surface, with the first bonding agent disposed therebetween, then prestressing the tensional member by applying tension to opposite ends of the tensional member, then releasing the tension forces after the first bonding agent hardens, and then performing step C.

8. The method according to claim 1 further comprising the step of applying an additional strip-shaped tensional member to the tensional member that is bonded to the concrete surface in steps B and C.

9. A reinforced/prestressed concrete structure in combination with a strip-shaped tensional member joined thereto to strengthen/restore the concrete structure; the tensional member including a middle portion, and two end portions disposed on opposite sides of the tensional member; the tensional member being prestressed only in the middle portion thereof; the prestressed middle portion being joined to a concrete surface of the concrete structure by a first bonding agent, the end portions being joined to the concrete surface by a second bonding agent, the second bonding agent having a lower deformation modulus than the first bonding agent.

10. The concrete structure according to claim 9 wherein the tensional member comprises steel fibers.

11. The concrete structure according to claim 9 wherein the tensional member comprises synthetic fibers.

12. The concrete structure according to claim 9 wherein the tensioning member comprises carbon fibers.

* * * * *